US009084942B2

(12) United States Patent
O'Hare

(10) Patent No.: US 9,084,942 B2
(45) Date of Patent: Jul. 21, 2015

(54) TOY

(75) Inventor: Michael O'Hare, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 689 days.

(21) Appl. No.: 12/902,591

(22) Filed: Oct. 12, 2010

(65) Prior Publication Data

US 2011/0086571 A1 Apr. 14, 2011

Related U.S. Application Data

(60) Provisional application No. 61/250,368, filed on Oct. 9, 2009.

(51) Int. Cl.
*A63H 3/20* (2006.01)
*A63H 3/46* (2006.01)

(52) U.S. Cl.
CPC ... *A63H 3/20* (2013.01); *A63H 3/46* (2013.01)

(58) Field of Classification Search
CPC ..... A63H 3/00; A63H 3/20; A63H 3/36; A63H 3/46
USPC ..... 446/236, 268, 330, 334, 337–340, 352, 446/376, 390
See application file for complete search history.

(56) References Cited

U.S. PATENT DOCUMENTS 2,961,794 A * 11/1960 Sachs et al. ..... 446/258
3,147,566 A * 9/1964 Ong ..... 446/359
3,243,916 A 4/1966 Ryan
3,641,702 A 2/1972 Gardel et al.
3,648,405 A 3/1972 Tepper
3,862,513 A * 1/1975 Isaacson et al. ..... 446/381
3,928,932 A 12/1975 Maurer
3,994,092 A 11/1976 Sapkus et al.
4,003,158 A * 1/1977 Wolf et al. ..... 446/334
4,063,381 A 12/1977 Deulofeu
4,135,327 A 1/1979 Sapkus et al.
4,141,176 A 2/1979 Flicker et al.
4,186,516 A 2/1980 Ensmann
4,279,419 A 7/1981 Barnes et al.
4,413,441 A * 11/1983 Hunter et al. ..... 446/305
4,596,532 A 6/1986 Cook et al.

(Continued)

FOREIGN PATENT DOCUMENTS

CN 2407807 Y 11/2000
CN 2610995 Y 4/2004

(Continued)

OTHER PUBLICATIONS

International Search Report dated Jun. 23, 2011 for International Application No. PCT/US2010/052278.

(Continued)

*Primary Examiner* — Eugene Kim
*Assistant Examiner* — Alyssa Hylinski
(74) *Attorney, Agent, or Firm* — Kolisch Hartwell, PC

(57) ABSTRACT

A toy figure is disclosed herein, the toy figure having: an upper body portion; a lower body portion, the upper portion being rotatably secured to the lower portion; at least one appendage movably secured to the lower portion; and a drive mechanism coupling the at least one appendage to the upper portion, wherein movement of the at least one appendage causes rotation of the upper portion with respect to the lower portion.

12 Claims, 6 Drawing Sheets

(56) References Cited

U.S. PATENT DOCUMENTS

| | | | | |
|---|---|---|---|---|
| 4,601,672 | A | 7/1986 | Cook et al. | |
| 4,605,382 | A * | 8/1986 | Cook et al. | 446/330 |
| 4,608,026 | A | 8/1986 | Newton et al. | |
| 4,623,318 | A * | 11/1986 | Tsiknopoulos et al. | 446/330 |
| 4,643,692 | A * | 2/1987 | Magers | 446/259 |
| 4,952,189 | A | 8/1990 | Barlow | |
| 4,968,280 | A | 11/1990 | Kelley | |
| 4,995,846 | A | 2/1991 | Mariol | |
| 5,045,015 | A | 9/1991 | Arad et al. | |
| 5,176,560 | A | 1/1993 | Wetherell et al. | |
| 5,727,982 | A * | 3/1998 | Hurt | 446/352 |
| 5,823,845 | A | 10/1998 | O'Berrigan | |
| 6,012,962 | A | 1/2000 | Arriola | |
| 6,022,263 | A | 2/2000 | Liu et al. | |
| 6,042,451 | A | 3/2000 | Feldman | |
| 6,106,359 | A * | 8/2000 | Arriola | 446/334 |
| 6,142,845 | A * | 11/2000 | Feldman | 446/15 |
| 6,152,799 | A * | 11/2000 | Arriola | 446/330 |
| 6,296,543 | B1 | 10/2001 | Andrews | |
| 6,579,143 | B1 | 6/2003 | Rehkemper et al. | |
| 7,338,341 | B2 | 3/2008 | Hoeting et al. | |
| 7,364,164 | B2 * | 4/2008 | Anasis et al. | 273/317.2 |
| 2008/0020670 | A1 | 1/2008 | Kratz | |
| 2008/0227363 | A1 | 9/2008 | Ali et al. | |
| 2009/0075555 | A1 | 3/2009 | Barthold | |
| 2009/0215358 | A1 | 8/2009 | Mootedath et al. | |

FOREIGN PATENT DOCUMENTS

| | | |
|---|---|---|
| GB | 2003734 A | 3/1979 |
| JP | 61-106295 | 7/1986 |
| JP | 9-253341 A | 9/1997 |

OTHER PUBLICATIONS

Written Opinion dated Jun. 23, 2011 for International Application No. PCT/US2010/052278.

Supplemental European Search Report dated May 8, 2013 for Application No. PCT/US2010/052278.

English Translation of CN2407807.

English Translation of CN2610995.

Office Action issued Nov. 27, 2013 for Chinese Patent Application No. 2010800556417.

* cited by examiner

TOY

CROSS REFERENCE TO RELATED APPLICATIONS

This application claims the benefit of U.S. Provisional Patent Application Ser. No. 61/250,368 filed Oct. 9, 2009, the contents of which are incorporated herein by reference thereto.

BACKGROUND

Various embodiments of the present invention relate to a toy and more particularly, a toy figure having articulating portions.

Children's toys have included miniature cars, boats, trains, figures, etc. wherein the user's imagination provides for hours of extended play and enjoyment. Toy figures that resemble fighting or combat type activities are particularly popular as the user can participate in imaginary battles or action sequences.

Accordingly, it is desirable to provide a toy that has articulating portions and allows for interaction with the user.

SUMMARY OF THE INVENTION

In one embodiment, a toy figure is provided, the toy figure having: an upper body portion; a lower body portion, the upper portion being rotatably secured to the lower portion; at least one appendage movably secured to the lower portion; and a drive mechanism coupling the at least one appendage to the upper portion, wherein movement of the at least one appendage causes rotation of the upper portion with respect to the lower portion.

In another embodiment, a toy figure is provided. The toy figure having: an upper body portion; a lower body portion, the upper portion being rotatably secured to the lower portion; a drive mechanism coupling the upper body portion to the lower body portion, wherein the drive mechanism further comprises a spring that is configured to provide a biasing force in a first direction as the upper body portion is rotated in a second direction with respect to the lower body portion, the second direction being opposite to the first direction; and an actuation button for releasing the biasing force such that the upper body portion can be rotated in the first direction with respect to the lower body portion.

In still another embodiment, a method for applying a rotational force to portions of a toy figure is provided. The method including the steps of: moving at least one appendage in a first direction with respect to a lower body portion of the toy figure, wherein movement of the at least one appendage in the first direction causes a drive mechanism to rotate an upper body portion of the toy figure with respect to the lower body portion; and moving the at least one appendage in a second direction with respect to the lower body portion of the toy figure, the second direction being opposite to the first direction and wherein movement of the at least one appendage in the second direction causes the drive mechanism to be disengaged from the upper body portion such that the upper body portion may continue to rotate with respect to the lower body portion.

BRIEF DESCRIPTION OF THE DRAWINGS

Other features, advantages and details appear, by way of example only, in the following description of embodiments, the description referring to the drawings in which.

DETAILED DESCRIPTION

Figure 1:
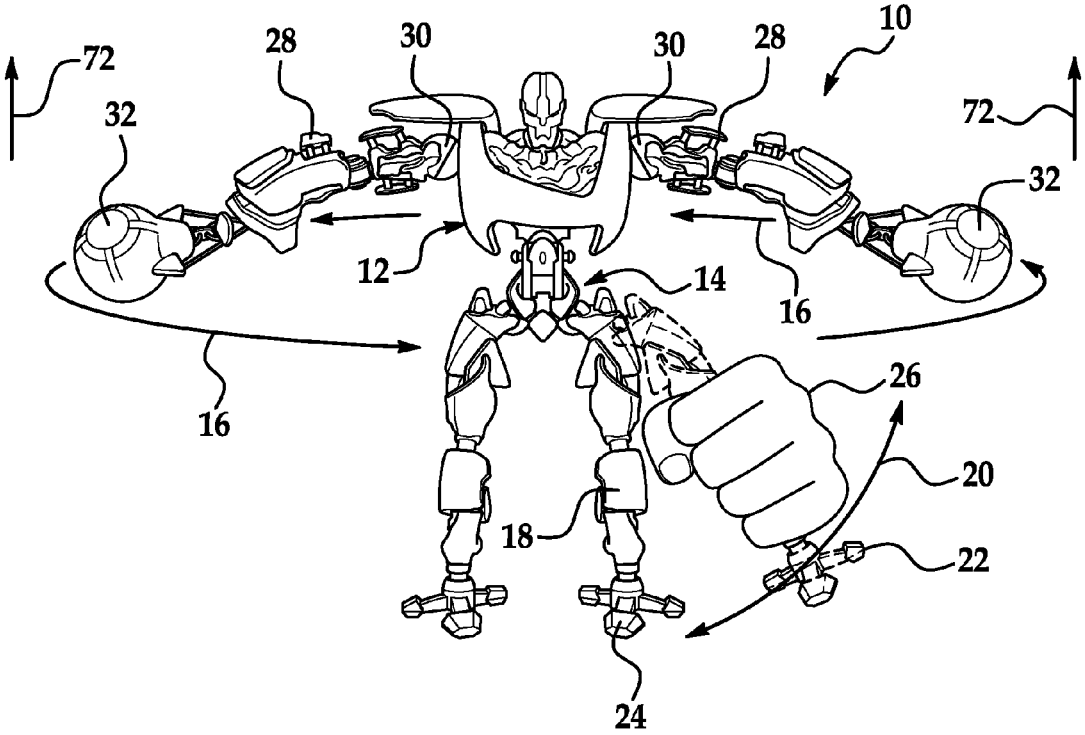
FIG. 1 is a view of a toy in accordance with one embodiment of the present invention.
Figure 2:
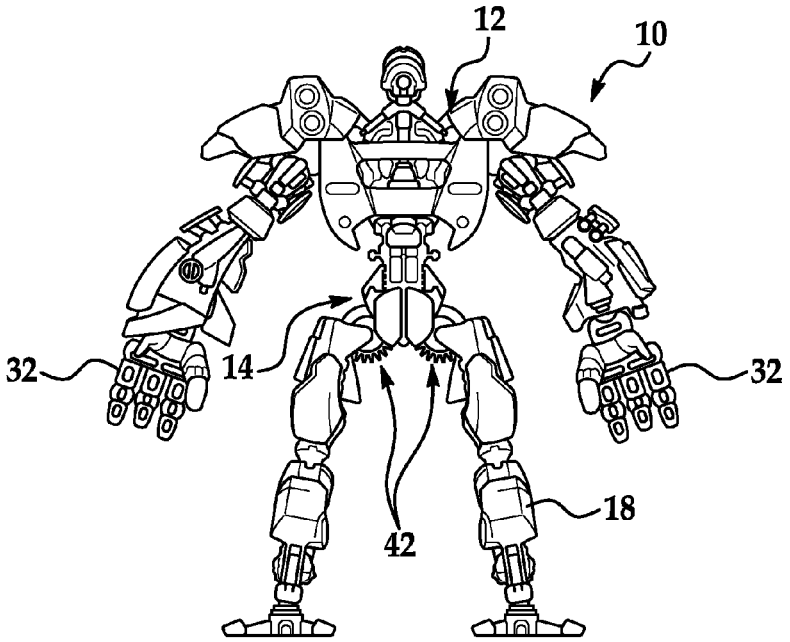
FIG. 2 is a front elevational view of a toy in accordance with an exemplary embodiment of the present invention.
Figure 3A:
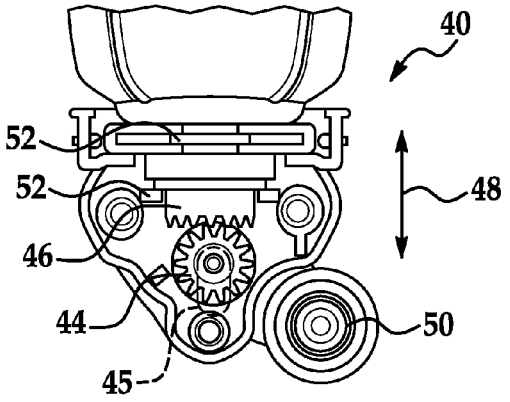
FIGS. 3A and 3B are views illustrating components of an exemplary embodiment of the present invention.
Figure 3B:
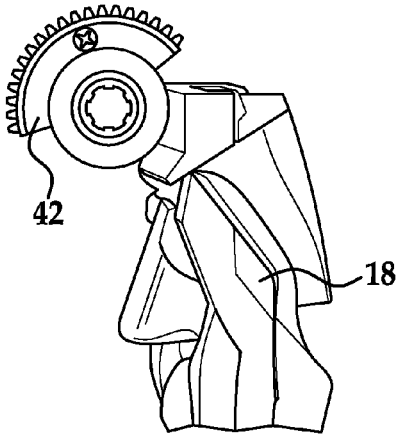
Figure 4:
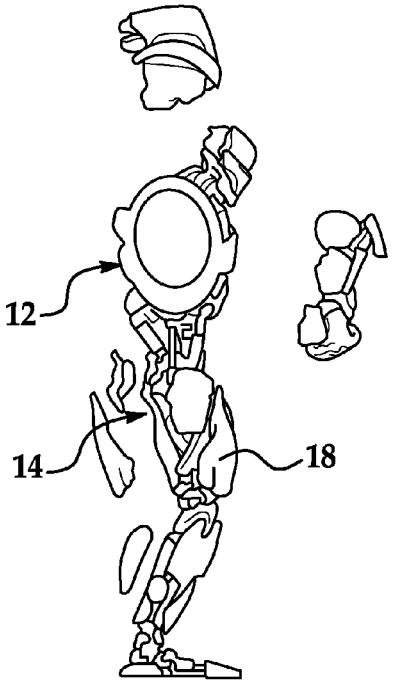
FIG. 4 is an exploded view of a portion of a toy in accordance with exemplary embodiments of the present invention.
Figure 4A:
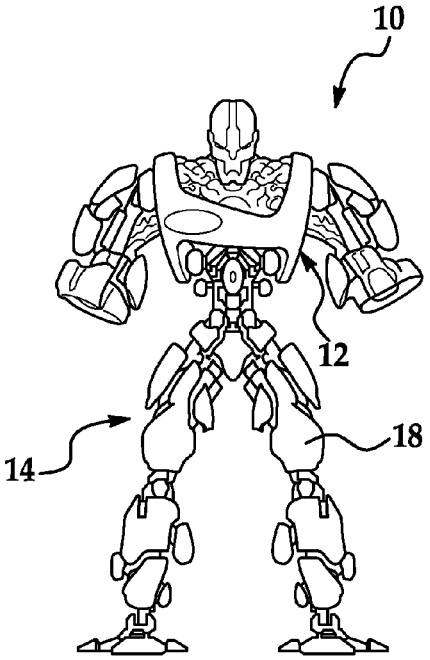
FIGS. 4A-4C are various views of an exemplary embodiment of the present invention.
Figure 4B:
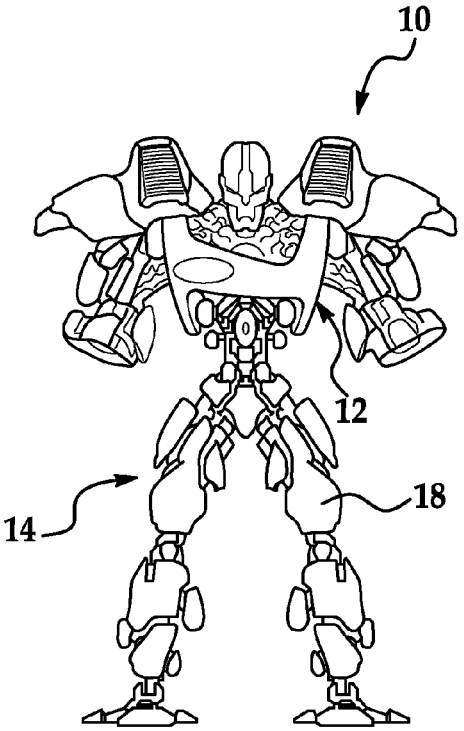
Figure 4C:
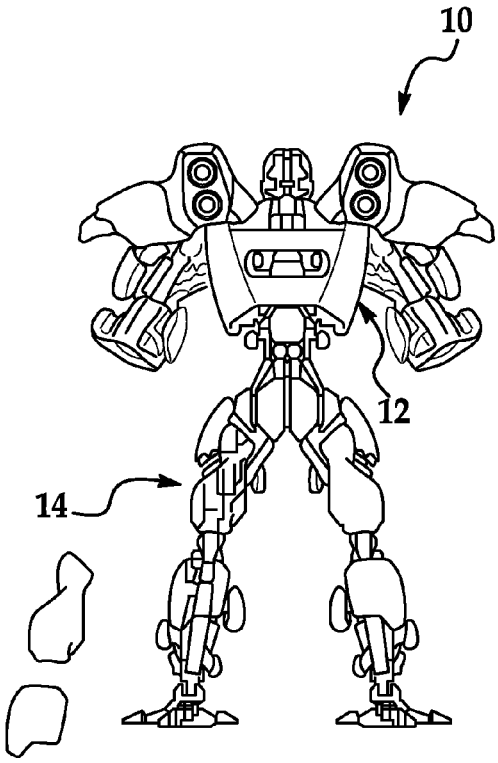
Figure 5:
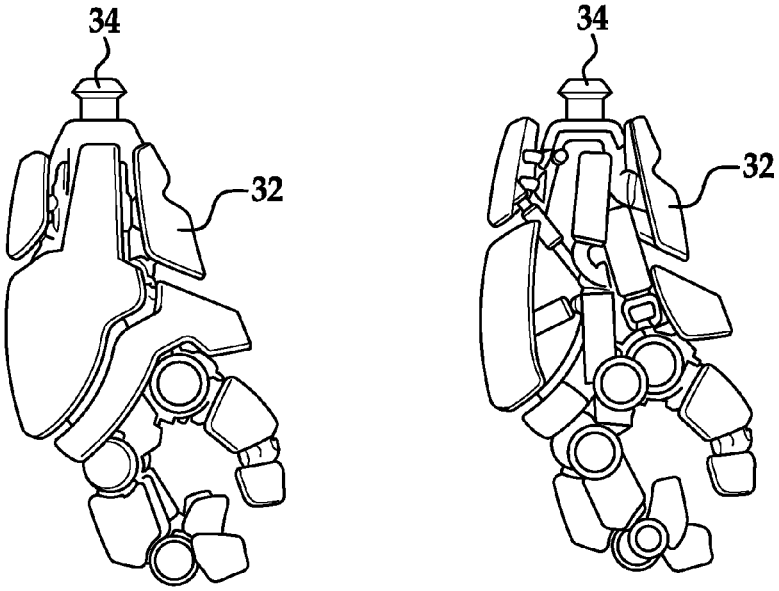
FIGS. 5-7 are views illustrating component parts of exemplary embodiments of the present invention.
Figure 6:
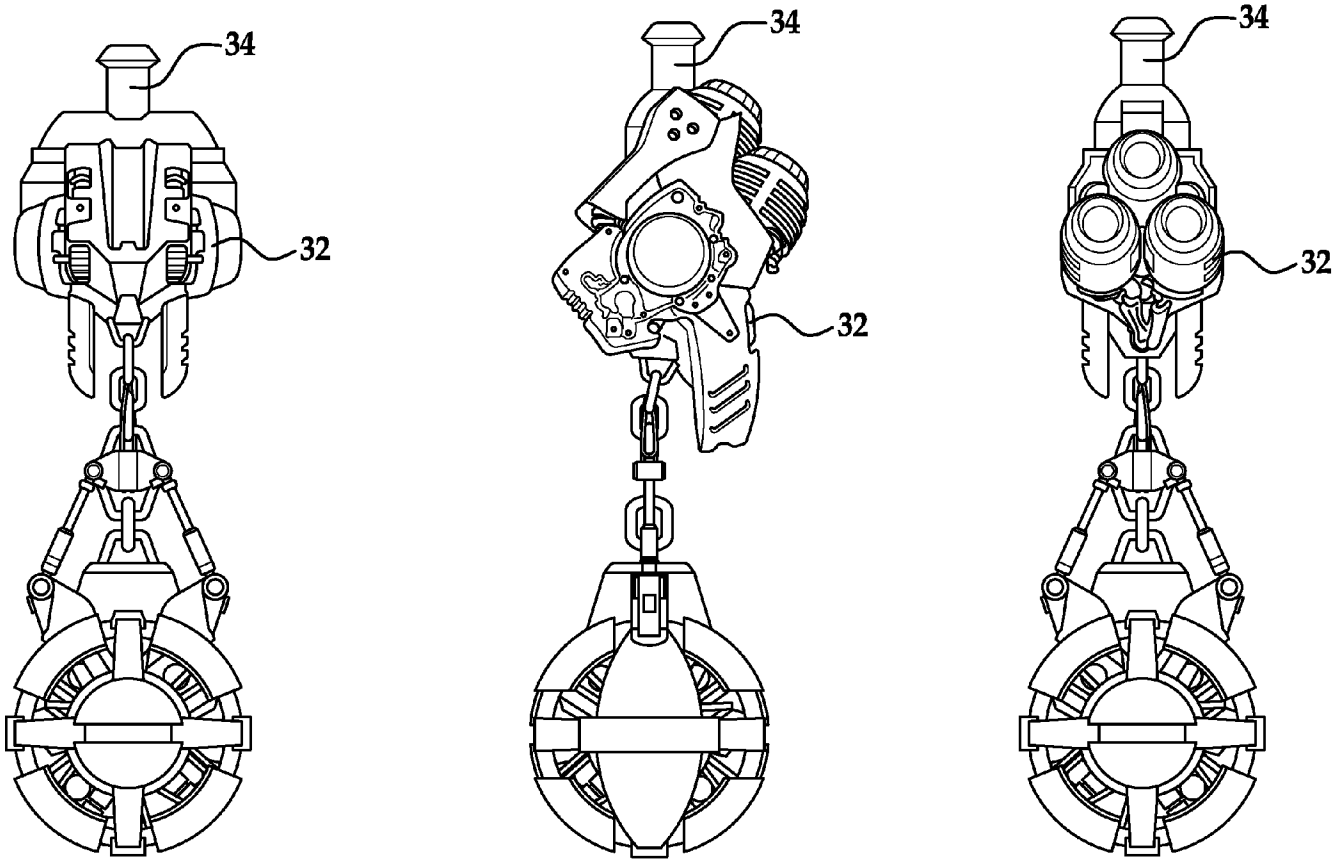
Figure 7:
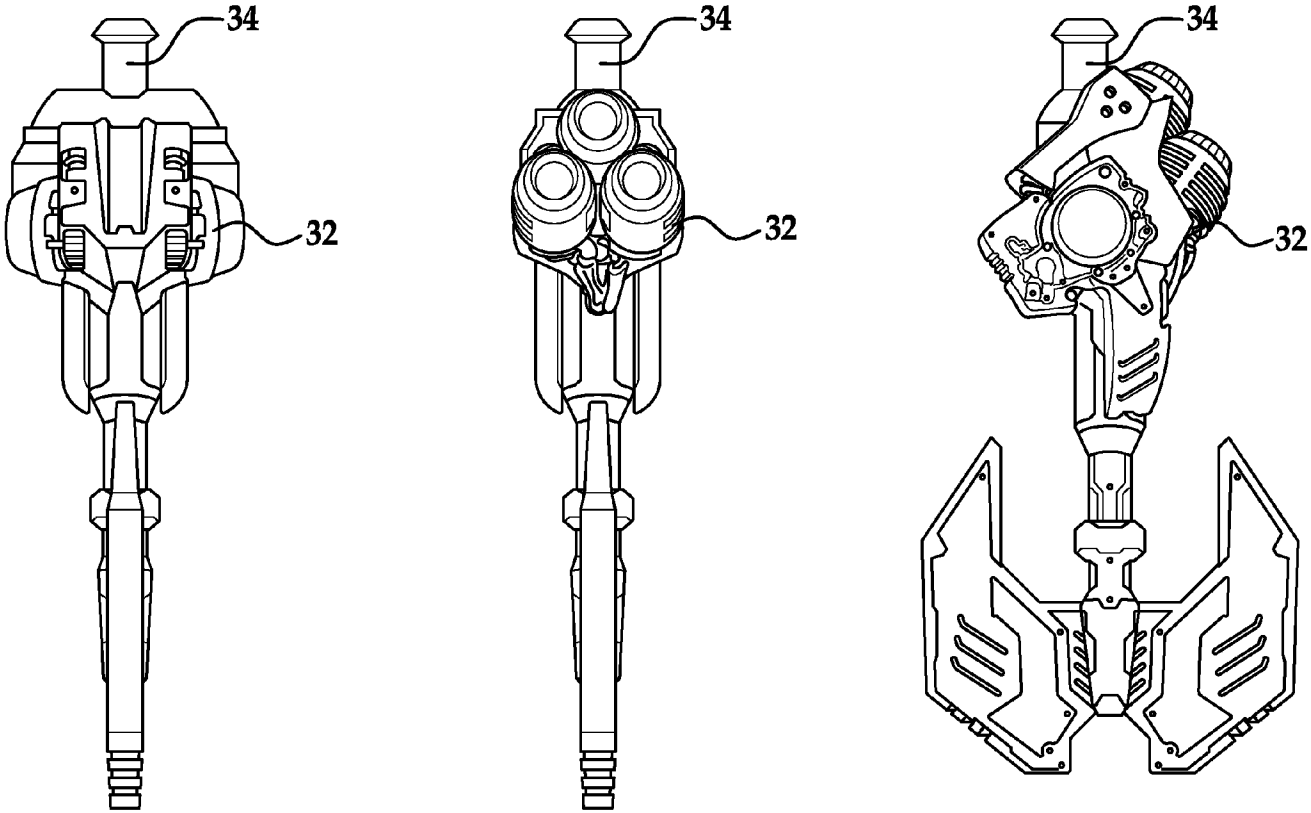

Referring now to FIGS. 1-9, various exemplary embodiments of a toy FIG. 10 are illustrated. In accordance with these exemplary embodiments portions of the toy as described herein may be formed out of an easily molded material such as plastic or any other equivalent materials. As will be further discussed herein, the toy has various embodiments or combinations thereof wherein the toy figure moves or sequences through a plurality of positions through rotating portions of the figure.

In one embodiment, the toy figure will resemble a human, humanoid, robot, character or any other type of configuration. Toy figure 10 has an upper body portion 12 and a lower body portion 14. The upper portion is rotatably secured to the lower portion such that the same may rotate in the directions of arrows 16 while the lower body portion remains stationary.

The lower body portion has at least one appendage or leg 18 movably or pivotally secured to the lower portion for movement in the direction of arrows 20 from a first position 22 to a second position 24 and vice versa. Manipulation of the leg or appendage 18 is facilitated by a user's hand 26 that can easily grasp leg 18.

The upper body portion has a pair of arms or articulating members 28 each being movably or pivotally secured to the upper body portion at a joint 30. In addition, each arm or member 28 has an item 32 removably secured to a distal end of the arm or member 28. Each item 32 has a connecting member or feature 34 configured to releasably engage a complimentary opening in the arm or member to allows for various items of differing configurations to be secured to the arm members. For example, one non-limiting configuration would be a ball and socket arrangement wherein the ball is insertable into the socket to allow movement therein while also allowing for removal of the ball from the socket such that another item can be inserted therein. Similarly, each of the arms may be secured to the upper body portion at joint 30 via a ball and socket arrangement or any other equivalent securement that will allow for movement of the arms with respect to the upper body portion. Still further, each of the arms may have a plurality of sections or segments (e.g., upper arm portion, forearm portion, etc.) wherein each of the arm segments are movably secured thereto by a similar arrangement such that articulating movement of the arm sections with respect to each other is provided and occurs when the upper body portion is rotated with respect to the lower body portion.

Various configurations of removable items 32 are illustrated in at least FIGS. 1, 2 and 5-7. Accordingly, each item 32 can be removed from and replaced into each distal end of the arm members to provide various play combinations. In another alternative embodiment, items 32 are simply fixedly secured to arms 28 such that they are not removable.

In accordance with one non-limiting exemplary embodiment and in order to facilitate rotation of the upper body portion with respect to the lower body portion when appendage or leg 18 is manipulated by a user, a drive mechanism 40 is provided. One such drive mechanism is illustrated in at least FIGS. 3A and 3B.

The drive mechanism 40 couples the at least one appendage to the upper body portion such that movement of the at least one appendage with respect to the lower body portion causes rotation of the upper body portion with respect to the lower portion. As illustrated, the drive mechanism comprises a first gear portion 42 secured to the at least one appendage, a second gear 44 movably secured to the lower body portion and a third gear 46 secured to the upper body portion. In one embodiment, the second gear 44 is mounted into a slot or elongated opening 45 that allows for movement of the second gear in the direction of arrows 48 as well as rotational movement thereof such that the first gear portion engages the second gear and the second gear engages the third gear when the at least one appendage or leg 18 moves in a first direction towards the second position 24 (FIG. 1) with respect to the lower portion and the second gear does not engage the third gear when the at least one appendage moves in a second direction with respect to the lower portion towards the first position 22 (FIG. 1), wherein the second direction is essentially opposite to the first direction. Therefore, a cranking or moving motion of leg 18 in one direction will provide rotational movement to the upper body portion while movement of the leg in an opposite direction will still allow for rotational movement of the upper body portion and also allow leg 18 to be repositioned such that it can once again be moved in the first direction to further add rotational forces to the upper body portion.

In one embodiment and in order to assist in facilitating the cranking of leg 18 and rotation of the upper body portion. The leg 18 is spring biased into the first position 22 by a spring 50 located in the lower body portion. In addition and in order to allow for rotational movement of the upper body portion with respect to the lower body portion friction reducing features or washers 52 are provided at the point of rotational securement of the upper body portion to the lower body portion.

As illustrated, the figure in one embodiment has a pair of legs 18 and in accordance with various embodiments disclosed herein one leg 18 may be used to facilitate rotation movement of the upper body portion or alternatively both legs can be used to facilitate rotation movement of the upper body portion wherein one leg moves the upper body portion in one direction and the other leg moves the upper body portion in an opposite direction. In still another alternative embodiment the toy may be configured such that movement of both legs causes movement of the upper body portion in a single direction. Here mechanism 40 is adapted to be engaged by either or alternatively both legs. Of course, numerous configurations are contemplated and exemplary embodiments of the present invention are not intended to be limited to the specific configurations disclosed herein.

As illustrated, the upper body portion has a pair of arms or articulating members 28 each being movably secured to the upper body portion at joint 30 and as the upper body portion rotates in the direction of arrows 16 arms 28 can move upwardly in the direction of arrows 72 due to the centripetal force generated by the rotating upper body portion.

Figure 8:
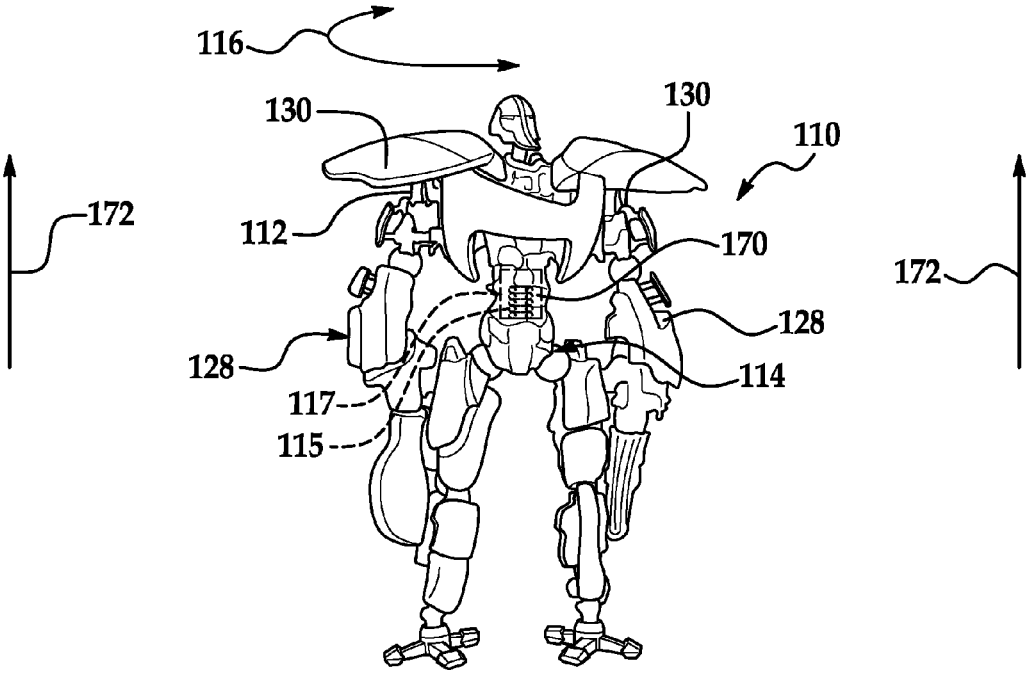
FIGS. 8 and 9 are views illustrating an alternative embodiment of the present invention.
Figure 9:
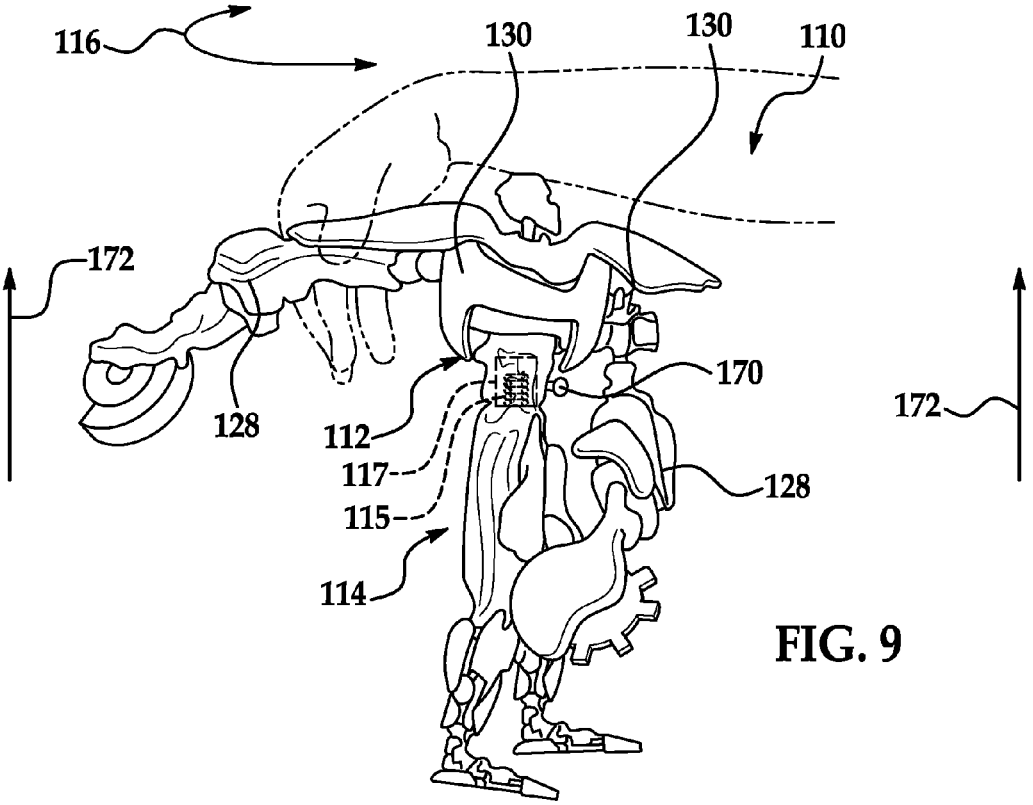

Referring now to FIGS. 8 and 9 an alternative exemplary embodiment 110 is provided. Here upper body portion 112 is rotatably secured to a lower body portion 114 similar to the previous embodiments. However rotation of the upper body portion 112 in the direction of one of the arrows 116 by a user's hand will cause a biasing member, spring or elastic member or any other equivalent 115 device internal to the toy and coupled to both the upper body portion and the lower body portion to build up a biasing force in a direction opposite to the previous rotation of the upper body portion such that upon release of the upper body portion the same will rotate with respect to the lower body portion. In one embodiment, a release button or switch 170 is provided for releasing a mechanism 117 that prevents rotation of the upper body portion with respect to the lower body portion even though an internal biasing force has been built up in spring 115. In other words, mechanism 117 is a one-way clutch, spring biased catch or any other equivalent device/mechanism that will allow the upper body portion to rotate in one direction with respect to the lower body portion while preventing movement in another opposite direction with respect to the lower body portion until it is released by an actuation button coupled thereto.

Accordingly, a user can wind the toy by rotating the upper body portion with respect to the lower body portion such that a biasing force in one direction is generated by manipulating spring 115 and rotational movement of the upper body portion with respect to the lower body portion in the direction of the biasing force is prevented by mechanism 117. Thereafter, movement of the upper body portion with respect to the lower body portion is facilitated by releasing the biasing force of the spring or other equivalent device 115 by pressing button 170 coupled to mechanism 117 by any suitable linkage or direct contact thereby releasing the upper body portion with respect to the lower body portion and allowing the upper body portion to rotate freely under the biasing force of the spring.

As illustrated, the upper body portion has a pair of arms or articulating members 128 each being movably secured to the upper body portion at a joint 130 and as the upper body portion rotates in the direction of arrows 116 arms 128 can move upwardly in the direction of arrows 172 due to the centripetal force generated by the rotating upper body portion.

In yet another alternative embodiment, the cranking mechanism of FIGS. 1-3B can be combined with the embodiment of FIGS. 8 and 9 such that movement of leg or appendage 18 will cause a biasing force to be generated by spring 115 and held in check until button 170 is pressed and the biasing force spring 115 is released.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A toy figure, comprising:

an upper body portion;

a lower body portion, the upper portion being rotatably secured to the lower portion about an axis of rotation;

at least one leg pivotally secured to the lower portion for movement between a first position and a second position; and a drive mechanism coupling the at least one leg to the upper portion, wherein movement of the at least one leg from the first position to the second position causes the upper portion to rotate completely about the axis of rotation in a first direction, and wherein the upper portion has a pair of arms each pivotally secured to the upper portion at a first end, wherein movement of the upper portion about the axis of rotation in the first direction causes a second end of each of the pair of arms to move in an upward direction, wherein the upward direction is parallel to the axis of rotation, wherein the drive mechanism comprises a first gear portion secured to the at least one leg, a second gear movably secured to the lower body portion and a third gear secured to the upper body portion, wherein the first gear portion engages the second gear and the second gear engages the third gear when the at least one leg moves in a first direction with respect to the lower portion, the first direction being from the first position of the at least one leg towards the second position of the at least one leg.

2. The toy figure as in claim 1, wherein each of the pair of arms has a distal member removably secured to the second end of each of the pair of arms.

3. The toy figure as in claim 1, wherein the at least one leg pivots about an axis that is perpendicular to the axis of rotation.

4. The toy figure as in claim 1, wherein the second gear does not engage the third gear when the at least one leg moves in a second direction with respect to the lower portion, the second direction being opposite to the first direction.

5. The toy figure as in claim 4, wherein the at least one leg is spring biased in the second direction towards the first position.

6. The toy figure as in claim 4, wherein the second gear is slidably received in an elongated slot that allows for linear movement of the second gear with respect to the lower body portion as well as rotational movement of the second gear with respect to the lower body portion.

7. A method for applying a rotational force to portions of a toy figure, the method comprising:

moving at least one leg in a first direction with respect to a lower body portion of the toy figure, the least one leg being pivotally secured to the lower body portion and wherein movement of the at least one leg in the first direction causes a drive mechanism to rotate an upper body portion of the toy figure completely about an axis of rotation in a one way rotational direction with respect to the lower body portion, wherein a pair of arms are each pivotally secured to the upper portion at a first end and movement of the upper portion completely about the axis of rotation in the one way rotational direction causes a second end of each of the pair of arms to move in an upward direction, wherein the upward direction is parallel to the axis of rotation; and moving the at least one leg in a second direction with respect to the lower body portion of the toy figure, the second direction being opposite to the first direction and wherein movement of the at least one leg in the second direction causes the drive mechanism to be disengaged from the upper body portion such that the upper body portion may continue to rotate in the one way rotational direction with respect to the lower body portion, wherein the drive mechanism comprises a first gear portion secured to the at least one leg, a second gear movably secured to the lower body portion and a third gear secured to the upper body portion, wherein the first gear portion engages the second gear and the second gear engages the third gear when the at least one leg moves in the first direction with respect to the lower portion.

8. The method as in claim 7, wherein each of the pair of arms has a distal member removably secured to each of the pair of arms.

9. The method of claim 7, wherein the at least one leg pivots about an axis that is perpendicular to the axis of rotation.

10. The method as in claim 7, wherein the second gear does not engage the third gear when the at least one leg moves in a second direction with respect to the lower portion.

11. The method as in claim 10, wherein the at least one leg is spring biased in the second direction.

12. The method as in claim as in claim 10, wherein the second gear is slidably received in an elongated slot that allows for linear movement of the second gear with respect to the lower body portion as well as rotational movement of the second gear with respect to the lower body portion.

* * * * *